US005382019A

United States Patent [19]

Sneed

[11] Patent Number: 5,382,019

[45] Date of Patent: Jan. 17, 1995

[54] GOLF PUTTER

[76] Inventor: Wilbert L. Sneed, 1004 McArthur Dr., Jacksonville, Ark. 72076

[21] Appl. No.: 190,357

[22] Filed: Feb. 1, 1994

[51] Int. Cl.[6] ..... A63B 53/04

[52] U.S. Cl. ..... 273/80 C; 273/167 G; 273/175

[58] Field of Search ..... 273/167 R, 167 A, 167 B, 273/167 C, 167 D, 167 E, 167 F, 167 G, 167 J, 168, 169, 80 C, 164.1, 77 R, 77 A, 187.4, 187.6, 174, 175

[56] References Cited

U.S. PATENT DOCUMENTS

| | | | |
|---|---|---|---|
| D. 209,760 | 1/1968 | Andis . | |
| D. 216,031 | 11/1969 | Blake . | |
| D. 235,272 | 6/1975 | Quast . | |
| 1,250,296 | 12/1917 | Fitzjohn et al. . | |
| 2,023,885 | 12/1935 | Hinckley | 273/175 |
| 2,478,468 | 8/1949 | Drake | 273/167 G |
| 2,843,384 | 7/1958 | Schmidt . | |
| 3,037,770 | 6/1962 | Palmer . | |
| 3,077,350 | 2/1963 | Koorland . | |
| 3,448,981 | 6/1969 | Anweiler . | |
| 3,989,257 | 11/1976 | Barr | 273/175 |
| 4,162,074 | 7/1979 | Thomson | 273/175 |
| 4,521,022 | 6/1985 | Schmidt | 273/175 |
| 4,722,528 | 2/1988 | Tsao | 273/80 C |
| 4,871,174 | 10/1989 | Kobayashi | 273/80 C |
| 5,267,733 | 12/1993 | Szokola | 273/80 C |

*Primary Examiner*—Sebastiano Passaniti
*Attorney, Agent, or Firm*—Richard C. Litman

[57] ABSTRACT

A golf putter includes a compound convex surface on the face of the club head. The convex surface formed by an arc in the horizontal plane, reduces the directional inaccuracy of a slightly misaimed putt. The vertically convex curvature assists in providing overspin on the ball when it is struck, thus promoting directional accuracy for the ball as it rolls. Additional advantages are provided in a convex curved bottom surface and angled relief for the club head, which serve to reduce the drag and "digging in" of the heel, toe, or other portion of the club head on the putting surface. The shaft joins the rear of the club head at a point aligned with the center of gravity of the club head, thus reducing the tendency for the club head to be deflected when the ball is struck squarely. The upper portion of the shaft is forwardly offset, to lie in the plane of the ball when the club head is in contact with the ball; this assists the alignment of the club head with the ball. Finally, the provision of an additional bend in the club shaft provides a clearer view of the ball when addressing and putting the ball, by displacing much of the club shaft from a position between the golfer's line of sight and the ball.

13 Claims, 1 Drawing Sheet

GOLF PUTTER

FIELD OF THE INVENTION

The present invention relates generally to golf clubs, and more specifically to a putter having various features which both separately and in combination provide for greater accuracy. The putter is of particular value for less experienced or skilled players of the game.

BACKGROUND OF THE INVENTION

The game of golf has enjoyed ever increasing popularity over the years, for various reasons. As with almost all games of skill, players of the game are generally anxious to improve their skills, whether in comparison with other players or relative to a previous personal best. However, golf can be particularly difficult game to learn to play well, as evidenced by the relatively high earning levels achieved by top professionals on the tournament circuit. Considering that the average amateur cannot devote the vast number of hours required to learn to play the game at its top level, any advantage which makes it easier for the amateur to lower his/her score is advantageous.

This is particularly true with the portion of the game relating to putting, for shorter distances on the green approaching the hole. There is an old adage among professional golfers: "Drive for show and putt for dough," which can be seen to emphasize the value of the shorter strokes of the game used in putting. As each stroke is counted the same, it will be seen that accuracy in the putting game is of relative importance.

A common error in putting, particularly with relatively unskilled players, is to slightly "open" or "close" the club head relative to the desired path of the ball, i.e., to inadvertently angle the club face slightly toward or away from the body. With a flat face on the club head, such an angular displacement will be seen to deflect the ball away from the desired path by twice the angular displacement of the club head face, much as if the ball were reflected or bounced from the angularly displaced surface of the club face. Such small angles of displacement are often difficult for the novice player to see, but errors in putting caused by such displacement are one of the prime causes of missed putts and resulting high scores among golfers. Indeed, additional problems arise with conventional putters and players using them, relating to difficulty in delivering a clean stroke due to contact with the surface of the putting green, inadvertent placement of backspin on the ball, etc.

The need arises for a golf putter having an arcuately convex face on the club head, to provide for some degree of automatic compensation for errors in club head alignment with the ball when putting. The putter preferably should provide a compound convex curvature to the club face, in order to minimize backspin and promote overspin or topspin to the ball when putting. In addition, provision for radial and angular clearance for the bottom of the club head is desirable to promote cleaner strokes. Alignment of the club shaft with the center of gravity of the club head, and ball when the club head properly strikes the ball, is also desirable in order to minimize arcuate displacement of the club head at impact with the ball.

DESCRIPTION OF THE PRIOR ART

U.S. Pat. No. 1,250,296 issued to Edward M. Fitzjohn et al. on Dec. 18, 1917 discloses a Golf Club having a flat, planar face on the club head. The face is also angled upwardly relative to the club shaft, which upward angle would impart some loft and backspin to the ball; such characteristics are not desirable in golf putters. Moreover, the attachment of the club shaft with the head does not appear to be at the center of gravity of the club head, thus allowing an impact force with the ball to potentially cause the club head to be arcuately deflected and arcuately displace the path of the ball, nor is the shaft aligned with the ball at impact to provide for ease of aligning the putt.

U.S. Pat. No. 2,478,468 issued to John F. Drake on Aug. 9, 1949 discloses a Golf Putter having a generally flat and planar club face, unlike the present invention. The club head includes a convex curved shoe extending rearwardly from its bottom portion, but the forwardmost portion is at a right angle to the club face, unlike the present invention. The club shaft does not appear to join with the center of gravity of the club head, and is positioned to the rear of the club face, thus increasing the difficulty in aligning the putt.

U.S. Pat. No. 2,843,384 issued to Theodore G. Schmidt on Jul. 15, 1958 discloses a Golf Putter having a symmetrical, mallet style head. The face of the club head is flat and planar, unlike the present putter invention, and the shaft joins the top of the club head, rather than being forwardly offset to align with the ball at impact to assist the golfer in the alignment of the putt, as in the present golf putter invention.

U.S. Pat. No. 3,037,770 issued to John S. Palmer on Jun. 5, 1962 discloses a Golf Club having a club head with a flat, planar face and a shallow pyramid shape for the back of the club head. While the peak of the pyramid is at the center of gravity of the club head, as is the intersection of the club shaft with the head, no forward offset of the shaft nor convex curvature of the club face is disclosed, as in the present putter.

U.S. Pat. No. 3,077,350 issued to Henry Koorland on Feb. 12, 1963 discloses a Golf Putter having a flat, planar club face, unlike the present golf putter. While the club shaft is forwardly offset to lie in the plane of the ball at impact, the shaft is not aligned with the center of gravity of the club head, thus providing the potential for the club head to be angularly displaced when the ball is struck due to the misalignment of the centers of gravity of the club head and ball.

U.S. Pat. No. 3,448,981 issued to Donald M. Anweiler on Jun. 10, 1969 discloses a Golf Club having a symmetrically shaped head and with the shaft forwardly offset to align with the ball at impact. However, other deficiencies are noted which have been described above, i.e., the lack of any angular relief along the bottom of the club head to the rear, and the flat, planar surface of the club head. The geometric center and center of gravity of the club head itself are also disposed lower than the center of the ball at impact, assuming the bottom of the club is adjacent the putting surface at that point.

U.S. Pat. No. D-209,760 issued to Ernest R. Andis on Jan. 2, 1968 discloses a design for a Golf Club Head. While the head is symmetrical, no shaft is disclosed, so the offset (if any) cannot be determined. Moreover, the face of the club head is flat and planar, unlike the present club head face, and is angled rearwardly from bottom to top of the face, which problem in imparting backspin to the ball has been discussed above.

U.S. Pat. No. D-216,031 issued to Minden V. Blake on Nov. 18, 1969 discloses a design for a Head Of A Golf Club. The face of the club head is flat and planar, and while the head is symmetrical, the shaft joins the club head at one end of the elongate front face, rather than at the center of gravity of rear of the head, as in the present invention.

Finally, U.S. Pat. No. D-235,272 issued to Martin E. Quast on Jun. 3, 1975 discloses a design for a Golf Club Head wherein the shaft appears to join the club head at the center of its back portion. Forward offset is provided for the shaft, but only to the extent to provide alignment with the center of the club head. The bottom of the head includes a convex curve, as in the present golf putter, but no upward inclination of the bottom of the head is provided for clearance from the putting surface. The face of the club head is flat and planar, as are all of the club head faces in the prior art discussed above.

None of the above noted patents, taken either singly or in combination, are seen to disclose the specific arrangement of concepts disclosed by the present invention.

SUMMARY OF THE INVENTION

By the present invention, an improved golf putter is disclosed.

Accordingly, one of the objects of the present invention is to provide an improved golf putter which includes a convex face having a relatively large radius relative to the horizontal axis of the club head, in order to provide a smaller error in the alignment of the path of the ball when the club is inaccurately aligned.

Another of the objects of the present invention is to provide an improved golf putter which includes a relatively short radius convex curvature of the club head face relative to the vertical axis of the club head, in order to promote forward spin on a ball which is struck by the club head.

Yet another of the objects of the present invention is to provide an improved golf putter which includes a relatively short radius convex curvature of the bottom of the club head, in order to preclude the "digging in" of the heel or toe of the club head due to the tilting of the club head from the vertical axis.

Still another of the objects of the present invention is to provide an improved golf putter which club shaft joins the club head on an axis through the center of gravity of the club head, and which includes a forward offset in order that at least the upper portion of the shaft is coplanar with the plane of the ball at impact.

A further object of the present invention is to provide an improved golf putter which club shaft may include at least some angular displacement from the vertical axis of the club head.

An additional object of the present invention is to provide an improved golf putter which includes an angular relief of the bottom surface of the club head, to reduce any bounce or other undesirable displacement of the club head due to contact with the putting surface.

Another object of the present invention is to provide an improved golf putter which may be constructed as a monolithic, cast or forged unit with the club shaft, or alternatively may be formed as a separate component.

A final object of the present invention is to provide an improved golf putter for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the figures of the attached drawings.

DETAILED DESCRIPTION OF THE PREFERRED EMBODIMENT

Figure 1:
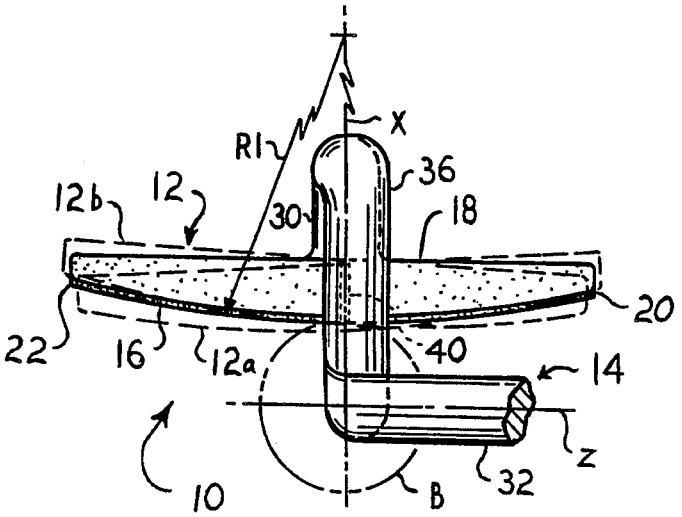
FIG. 1 is a top plan view of the club head and adjacent portion of the shaft of the present invention, showing the forward offset of the shaft relative to the club head and the arcuate convex surface of the club face in a horizontal axis across the club face.

Referring now to the drawings, the present invention will be seen to relate to a golf putter 10 generally comprising a club head 12 and a shaft 14 extending therefrom. (The shaft 14 is only partially shown, as the present invention lies in the configuration of the club head and the offset portions of the shaft immediately adjacent the club head; the undisclosed portion of the shaft is conventional. Also, while a club for right handed players is shown, it will be understood that the present invention is equally adaptable to left hand clubs.) The club head 12 includes a front face 16 and opposite rear surface 18, and extends between a first end 20 and a second end 22, with the first end 20 being normally disposed closer to the player holding the club shaft for normal play and the second end 22 located opposite the first end 20.

The configuration of the club head 12 is best understood by referring to a series of mutually orthogonic axes, with the first axis X defined as being coaxial with the intended path of the ball B and path of the club head 12 at the point of contact with the ball B; the second or Y axis being coaxial with the vertical axis of the ball at the point of contact with the center of the club head 12; and the third or Z axis passing through the ball B from left to right, at right angles to its intended path.

The X axis will be seen to pass through the center of gravity of the ball B and also through the center of the club head 12 when the club head is squarely aligned with the ball. It will be noted that the club face 16 forms an arcuately convex surface between the first and second ends 20 and 22 of the club head 12, defined by a horizontal radius R1 originating from a point along the X axis and behind the club head 12, shown in FIG. 1. This convex curvature is advantageous to the average amateur golfer, as one of the more difficult tasks in golf is to align accurately a club head with the intended path of the ball; a slight misalignment will be seen to cause an error in the path of the ball of twice the original club head misalignment due to the principle of reflection. As an example, a misalignment error of ½ degree would result in a one degree difference between the ideal or intended path of the ball and the actual path of the ball, equal to a lateral error on the order of some six inches for a thirty foot putt. Such misalignment errors are almost entirely due to a golfer slightly "opening" (i.e., twisting his/her grip away from the body, to cause the ball to go to the right of the intended path for a right handed golfer) or "closing" (twisting the grip toward the body) his or her grip, thus causing the club head face 16 to pivot arcuately generally about a vertical axis parallel to the Y axis defined above. As the convex curvature of the club face 16 defined by the radius R1 results in a horizontal tangent to any point on the club face being at right angles to the horizontal radius R1, any arcuate displacement of the club face about the origin of the radius R1 (as indicated by the arcuately displaced club heads 12*a* and 12*b* in FIG. 1) will result in the ball B being struck at the proper angle, assuming the ball B is struck substantially with the center of the club head 12.

Preferably, the radius R1 is relatively long, in order to minimize acute changes in the angle of the club face 16 if the ball B is struck with the club head 12 in other than exact alignment. It will be understood that the radius R1 shown in FIG. 1 is shown considerably foreshortened and the curvature of the club face 16 is considerably exaggerated for clarity in the drawings. It has been found that a radius R1 on the order of some seven feet (84 inches) provides the proper effect. However, the radius R1 may be adjusted to be longer or shorter, and thus respectively produce a lesser or greater degree of curvature for the club face 16, if desired.

Figure 3:
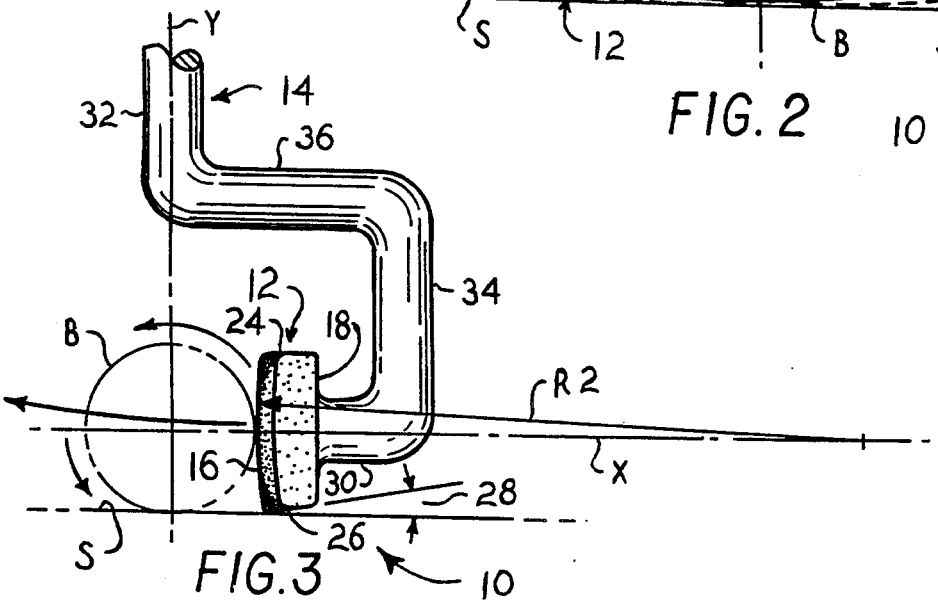
FIG. 3 is a left side view of the club head and lower portion of the shaft, showing the positive offset of the shaft, the angular relief of the bottom surface of the club head, and the convex curvature of the club face in the vertical plane.

The club face 16 may include a second arcuately convex curvature between the upper edge 24 and the bottom 26 of the club head 12, defined by a second radius R2 in the vertical plane and originating at a point on the X axis, as shown in FIG. 3. This curvature defined by radius R2 is advantageous in providing topspin or overspin on the ball B as it is struck. It will be seen that as the club 10 is swung on a normal, arcuate path, the club head 12 will begin to rise after contacting the ball B. In the case of a standard, flat club face, the face will take on an increasingly large angle from the vertical, tending to lift the ball and to cause the ball to "roll up" the face of the club slightly. The result is that the ball initially tends to spin rearwardly (i.e., to have "backspin"), which slows the forward velocity of the ball, shortens its intended rolling distance, and decreases the accuracy of the putt. While backspin is desirable in many golf shots when the ball is in flight, in order to reduce or eliminate the forward roll of the ball when it strikes the ground, such backspin is not desirable in putting, for the reasons noted above.

As the club face 16 begins its arcuately upward path upon striking the ball B, it will be seen that with a vertical tangent to any point on the club face being at right angles to the radius R2 in the vertical plane, that the contact point with the ball B will always be essentially vertical and thus will considerably reduce or eliminate any lifting or placement of backspin on the ball B. In fact, a sufficiently small radius R2 will serve to increase overspin or topspin on the ball B, as the arcuate surface will tend to roll over and pass over the ball B at the end of the putting stroke. While such a relatively small radius R2 is not desirable due to the difficulties of control presented, preferably the radius R2 is considerably shorter than the radius R1 of FIG. 1 discussed above. It has been found that a radius R2 on the order of seven inches works well to substantially reduce or eliminate any backspin which might otherwise be placed on the ball B during the putting stroke. However, other radii of greater or lesser length may be used as desired.

Another problem which occurs, particularly with other than expert or professional golfers, is failure to maintain the club head precisely parallel to the putting surface S. When this occurs, either the heel (the area of the lower corner defined by the bottom 26 and first end 20 of the club head) or the toe (the opposite lower corner defined by the bottom 26 and second end 22 of the club head) will tend to drag on the putting surface S. As the heel and toe of the club head 12 are displaced from the center of the club head, such drag will tend to cause the angle of the club face 16 to "close" (if the heel drags) or to "open" if the toe drags). In either case, putting accuracy may be degraded to a considerable extent.

Figure 2:
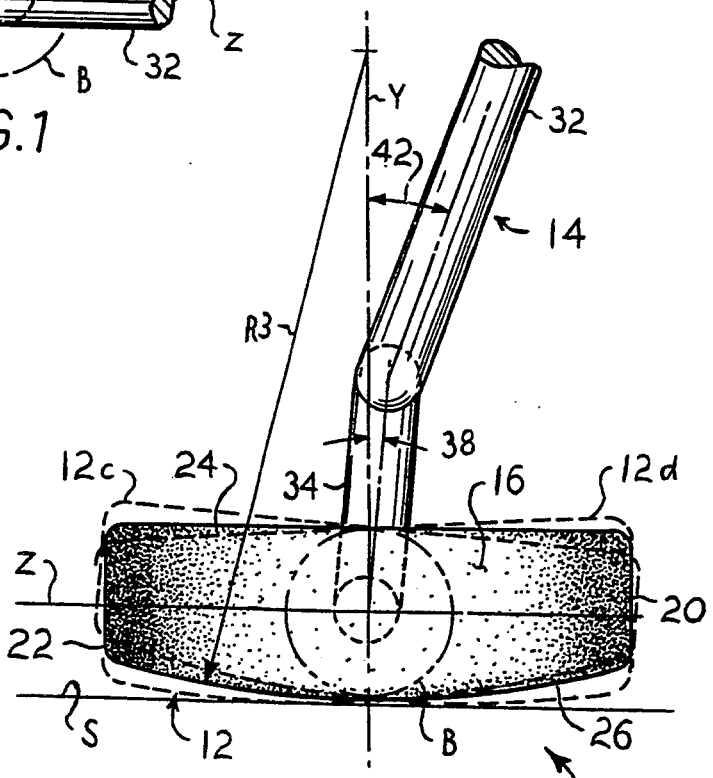
FIG. 2 is a front elevation view of the club head and lower portion of the shaft, showing the angular offset of the shaft attachment and configuration and the convex curvature of the bottom of the club head.

The present putter provides a solution to the above problem by providing an arcuately convex curvature for the bottom surface 26 of the club head 12, defined by a lateral radius R3 originating from a point vertically above the club head 12, directly behind the Y axis defined above. This convex rounding of the bottom 26 of the club head 12, substantially removes the lower corners, or heel and toe portions, of the club head 12 to provide clearance for a club head 12 arcuately displaced about the X axis. As can be seen by the displaced club head representations 12*c* and 12*d* in FIG. 2, any drag of the club head 12 against the surface S will still occur substantially directly beneath the X axis passing through the center of the club head 12, thus precluding any angular deflection of the club head 12 on the putting stroke. While any desired radius may be used, it has been found that a radius R3 on the order of seven to fourteen inches, or from one to two times the radius R2 defining the vertical curvature of the club face 16, is suitable.

Further clearance is provided by the angular relief 28 on the bottom 26 of the club head, extending rearward from the lower edge of the front face 16. By forming the bottom 26 of the club head at an angle, greater clearance is provided to reduce or preclude contact of the rear of the club head 12 with the underlying surface S on the follow through, and any resulting skip or divergence of the club head from the desired path (and consequent alteration of the path of the ball B). Typically, an angle 28 of some five degrees is sufficient to provide adequate clearance, but greater or smaller angles may be provided, depending upon the precise use and environment of the club 10.

Two of the above discussed features, namely the convex curvatures of the face 16 of the club head 12 defined by the radii R1 and R2, will be seen to provide directly for a more accurate path for the ball B when it is struck, while the other two features, i.e. the convex curvature and angular relief of the bottom 26 of the club head 12, assist in precluding undesired contact of the club head 12 with the underlying putting surface S and thereby deflecting the head 12 (and ball B being struck by the head 12) along an undesired path. However, the present putter 10 will be seen to provide additional features which provide even greater accuracy for putting strokes.

A review of the drawing figures shows that the lower end 30 of the shaft 14 is horizontal and intersects the substantially vertical rear surface 18 of the club head 12 at its geometric center at essentially a right angle, coaxially with the X axis of the ball B (and club head 12 when centrally aligned with the ball B). As the shaft 14 joins the club head 12 centrally, no angular deflection of the club head 12 is produced when the ball B is struck squarely at the center of the club face 16. Again, greater accuracy is the result of such a configuration.

It will be noted that the upper portion 32 of the shaft 14 of the present club 10 is forwardly offset, relative to the club face 16 and the intended path of the ball B when struck. This is achieved by including an upwardly rising lower shaft segment 34, which connects to a horizontal intermediate shaft segment 36 which extends forwardly, over the club head 12. The upper shaft portion 32 extends generally upwardly from the forward end of the intermediate segment 36, and is coplanar with the Y axis of the ball B when the ball is in contact with the club face 16.

The above angular arrangement of the shaft 14 provides various advantages in addition to the intersection of the lower end of the shaft 30 with the center of the club head 12, as will be discussed immediately below. By providing two different generally vertical portions of shaft 14 (i.e., the lower shaft segment 34 and the upper portion 32), different angles may be built in to these two portions of the shaft 14 relative to the horizontal axis (parallel to the left/right Z axis of the ball B) of the club head 12. A lower shaft segment angle 38 may be provided to offset the lower shaft segment 34 toward the golfer, if desired. This angular offset 38 will be seen to align more closely the intermediate shaft segment 36 with the desired putting line when viewed from above by a golfer addressing the ball B. While the shaft 14 and club head 12 may be formed separately, they may also be cast or forged as a unitary, monolithic single component, as shown in the drawing figures, depending upon the type of construction desired.

An additional alignment feature is the groove or line 40 (FIG. 1) formed in the upper surface or edge 24 of the club head 12 and perpendicular to the center of the face 16. This mark or line 40 serves to assist the golfer in aligning the center of the club head 12 with the center of the ball B for a more accurate putt. By offsetting the intermediate portion 36 of the shaft 14 by means of angle 38, the golfer may more easily view the alignment line 40, and/or precisely align it with one edge of the intermediate shaft portion 36 in order to visualize more accurately the desired path for the ball B. While the offset angle 38 may be formed as desired during the manufacture of the present putter 10, it has been found that a lower offset angle on the order of seven degrees works well.

The upper portion 32 of the shaft 14 may also be formed with an angular offset 42, if desired, in order to provide a more horizontal alignment for the club head 12 relative to the golfer who is normally standing to one side of the alignment path of the ball B when addressing the ball. Generally, the upper offset 42 is preferably on the order of some three or more times that of the lower offset 38, or some 21 to 24 degrees in addition to the angular offset 38 of the lower shaft segment 34. Again, different angles may be formed as desired, and in fact the difference between the lower segment angular offset 38 and the upper shaft portion offset 42 may be eliminated, with the upper shaft portion 32 and the lower shaft segment 34 being coplanar, if desired.

In accordance with the above disclosure, the present golf putter 10 will be seen to provide for greater accuracy than previously available in the art, particularly for less skilled or experienced players. The alignment features provided by the intermediate shaft portion 36, along with the alignment marking 40, provide valuable assistance to a golfer in aligning the putter 10 with the center of the ball B and with the desired path of the ball. Moreover, the arcuately convex face 16 of the club head 12 serves to reduce the magnitude of the result of any angular misalignment during the putting stroke, and further to reduce or eliminate any backspin which might degrade the accuracy of the putt. Finally, the arcuate curvature and angular relief of the bottom side 26 of the head, preclude inadvertent misalignment of the club head 12 due to unsymmetrical contact with the surface.

It is to be understood that the present invention is not limited to the sole embodiment described above, but encompasses any and all embodiments within the scope of the following claims.

I claim:

1. A golf putter for striking a golf ball in the game of golf, said golf putter comprising:

a club head including a shaft extending therefrom;

said club head further including opposite first and second ends and opposite top and bottom surfaces, said first and second ends and said top and bottom surfaces defining a front face and an opposite rear surface, said front face and said rear surface each including a geometric center;

said club head further includes a horizontal lateral axis extending thereacross, said shaft includes a lower shaft segment and an upper shaft portion, each having an angular displacement from a perpendicular relationship relative to said horizontal lateral axis of said club head;

said angular displacement of said upper shaft portion being greater than said angular displacement of said lower shaft segment;

said front face including a convex curvature thereon, whereby;

said convex curvature of said front face of said club head reduces inadvertent error in the path of a ball struck by said golf putter due to inadvertent arcuate misalignment of said front face of said club head when the ball is struck substantially at said geometric center of said front face.

2. The golf putter of claim 1 wherein:

said club head further includes a horizontal axis extending through each said geometric center of said front face and said rear face, and said convex curvature of said front face forms an arc between said first end and said second end of said club head and is defined by a horizontal radius originating from a point on said horizontal axis.

3. The golf putter of claim 1 wherein:

said club head further includes a horizontal axis extending through each said geometric center of said front face and said rear face, and said convex curvature of said front face forms an arc between said top surface and said bottom surface of said club head and is defined by a vertical radius originating from a point on said horizontal axis.

4. The golf putter of claim 1 wherein:

said club head further includes a horizontal axis extending through each said geometric center of said front face and said rear face, and said convex curvature of said front face forms a first arc between said first end and said second end of said club head defined by a horizontal radius originating from a point on said horizontal axis, and a second arc between said top surface and said bottom surface of said club head defined by a vertical radius originating from a point on said horizontal axis, whereby;

said front face of said club head comprises a compound convex arcuate curvature.

5. The golf putter of claim 4 wherein:

said horizontal radius defining said first arc is longer than said vertical radius defining said second arc.

6. The golf putter of claim 1 wherein:

said bottom surface of said club head comprises a convex surface forming an arc extending between said first end and said second end of said club head, with said arc of said bottom surface defined by a lateral radius originating from a point above said bottom surface of said club head.

7. The golf putter of claim 1 wherein:

said bottom surface of said club head comprises an angular slope extending upward between said front face and said rear surface of said club head.

8. The golf putter of claim 1 wherein:

said shaft includes a lower end extending from said geometric center of said rear surface of said club head.

9. The golf putter of claim 1 wherein:

said shaft includes a forwardly offset upper portion.

10. The golf putter of claim 9 wherein:

said forwardly offset upper portion of said shaft is spaced forwardly of said front face of said club head a distance equal to one golf ball radius.

11. The golf putter of claim 1 including:

a sight line extending across said top surface between said front face and said rear surface of said club head.

12. The golf putter of claim 1 wherein:

said club head includes a horizontal lateral axis extending thereacross, and said shaft includes at least a lower shaft segment angularly displaced from a perpendicular relationship relative to said horizontal lateral axis of said club head.

13. The golf putter of claim 1 wherein:

said club head and said shaft are formed as a unitary, monolithic unit.

* * * * *